US011609535B2

(12) United States Patent
Hoshino et al.

(10) Patent No.: US 11,609,535 B2
(45) Date of Patent: Mar. 21, 2023

(54) IMAGE FORMING APPARATUS HAVING GUIDE MEMBERS FOR DETACHABLY INSERTING CARTRIDGES

(71) Applicant: FUJIFILM Business Innovation Corp., Tokyo (JP)

(72) Inventors: Yuta Hoshino, Ebina (JP); Kiyohito Horii, Ebina (JP); Kenji Suzuki, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/399,258

(22) Filed: Aug. 11, 2021

(65) Prior Publication Data

US 2022/0308523 A1 Sep. 29, 2022

(30) Foreign Application Priority Data

Mar. 29, 2021 (JP) ..... JP2021-054459

(51) Int. Cl.
*G03G 21/18* (2006.01)
*G03G 21/16* (2006.01)

(52) U.S. Cl.
CPC ..... *G03G 21/1853* (2013.01); *G03G 21/1647* (2013.01); *G03G 21/1676* (2013.01); *G03G 2221/1884* (2013.01)

(58) Field of Classification Search
CPC ..... G03G 21/1642; G03G 21/1647; G03G 21/1676; G03G 21/1842; G03G 21/185;
(Continued)

(56) References Cited

U.S. PATENT DOCUMENTS 6,088,555 A 7/2000 Mizuno
2011/0299873 A1 12/2011 Ushiozu et al.
(Continued)

FOREIGN PATENT DOCUMENTS

JP 9-127851 A 5/1997
JP 2004101961 A 4/2004
(Continued)

OTHER PUBLICATIONS

Communication dated Jan. 25, 2022 issued by the European Patent Office in application No. 21193389.0.

*Primary Examiner* — Sophia S Chen
(74) *Attorney, Agent, or Firm* — Sughrue Mion, PLLC

(57) ABSTRACT

An image forming apparatus includes: a first guide that is provided in an apparatus housing and configured to suspend and hold a first unit including an image holder so that the first unit is movable in an insertion and removal direction; a second guide that is provided in the apparatus housing and configured to suspend and hold a second unit including a developer holder so that the second unit is movable in an insertion and removal direction; and a pedestal that is disposed on a front side in the insertion and removal direction with respect to the first guide and the second guide, supports, from below in a gravity direction, the first unit and the second unit while the first unit and the second unit are inserted into the apparatus housing, and does not contact with the first unit and the second unit located in the apparatus housing.

15 Claims, 7 Drawing Sheets

(58) Field of Classification Search
CPC ..... G03G 21/1853; G03G 2221/1853; G03G 2221/1884
See application file for complete search history.

(56) References Cited

U.S. PATENT DOCUMENTS

| | | | | |
|---|---|---|---|---|
| 2014/0348536 | A1* | 11/2014 | Ohashi | G03G 21/1647 399/119 |
| 2017/0293258 | A1* | 10/2017 | Shimizu | G03G 21/1842 |
| 2020/0257221 | A1 | 8/2020 | Akaike et al. | |
| 2020/0310339 | A1 | 10/2020 | Yokoi et al. | |

FOREIGN PATENT DOCUMENTS

| | | | |
|---|---|---|---|
| JP | 3536577 | B2 | 6/2004 |
| JP | 2020095166 | A | 6/2020 |

* cited by examiner

IMAGE FORMING APPARATUS HAVING GUIDE MEMBERS FOR DETACHABLY INSERTING CARTRIDGES

CROSS-REFERENCE TO RELATED APPLICATIONS

This application is based on and claims priority under 35 USC 119 from Japanese Patent Application No. 2021-054459 filed on Mar. 29, 2021.

BACKGROUND

Technical Field

The present invention relates to an image forming apparatus.

Related Art

There is an image forming apparatus including plural cartridges that are detachably inserted in a predetermined position of an apparatus main body in a predetermined order and a predetermined insertion path formed by a guide, in which a guide portion that guides insertion of another cartridge to be inserted next in the predetermined position of the apparatus main body in a state where the cartridge is inserted in the predetermined position of the apparatus main body is provided on the cartridge inserted before another cartridge is inserted, a guided portion that is guided by the guide portion formed on another cartridge that has been inserted into the predetermined position of the apparatus main body, by which the cartridge is inserted into the predetermined position of the apparatus main body, is provided on the cartridge to be inserted after the other cartridge is inserted, the guide portion is a surface that guides the other cartridge such that the other cartridge is inserted into a guide provided in the apparatus main body which guides insertion of the other cartridge, and the guide portion cooperates with the guide of the apparatus main body (Japanese Patent No. 3536577).

SUMMARY

Aspects of non-limiting embodiments of the present disclosure relate to facilitating unit replacement, preventing damage to the units, and suppressing retention of a toner cloud between units.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a first guide that is provided in an apparatus housing and configured to suspend and hold a first unit including an image holder so that the first unit is movable in an insertion and removal direction; a second guide that is provided in the apparatus housing and configured to suspend and hold a second unit including a developer holder so that the second unit is movable in an insertion and removal direction; and a pedestal that is disposed on a front side in the insertion and removal direction with respect to the first guide and the second guide, supports, from below in a gravity direction, the first unit and the second unit while the first unit and the second unit are inserted into the apparatus housing, and does not contact with the first unit and the second unit located in the apparatus housing.

BRIEF DESCRIPTION OF THE DRAWINGS

Exemplary embodiment(s) of the present invention will be described in detail based on the following figures, wherein.

DETAILED DESCRIPTION

Figure 1:
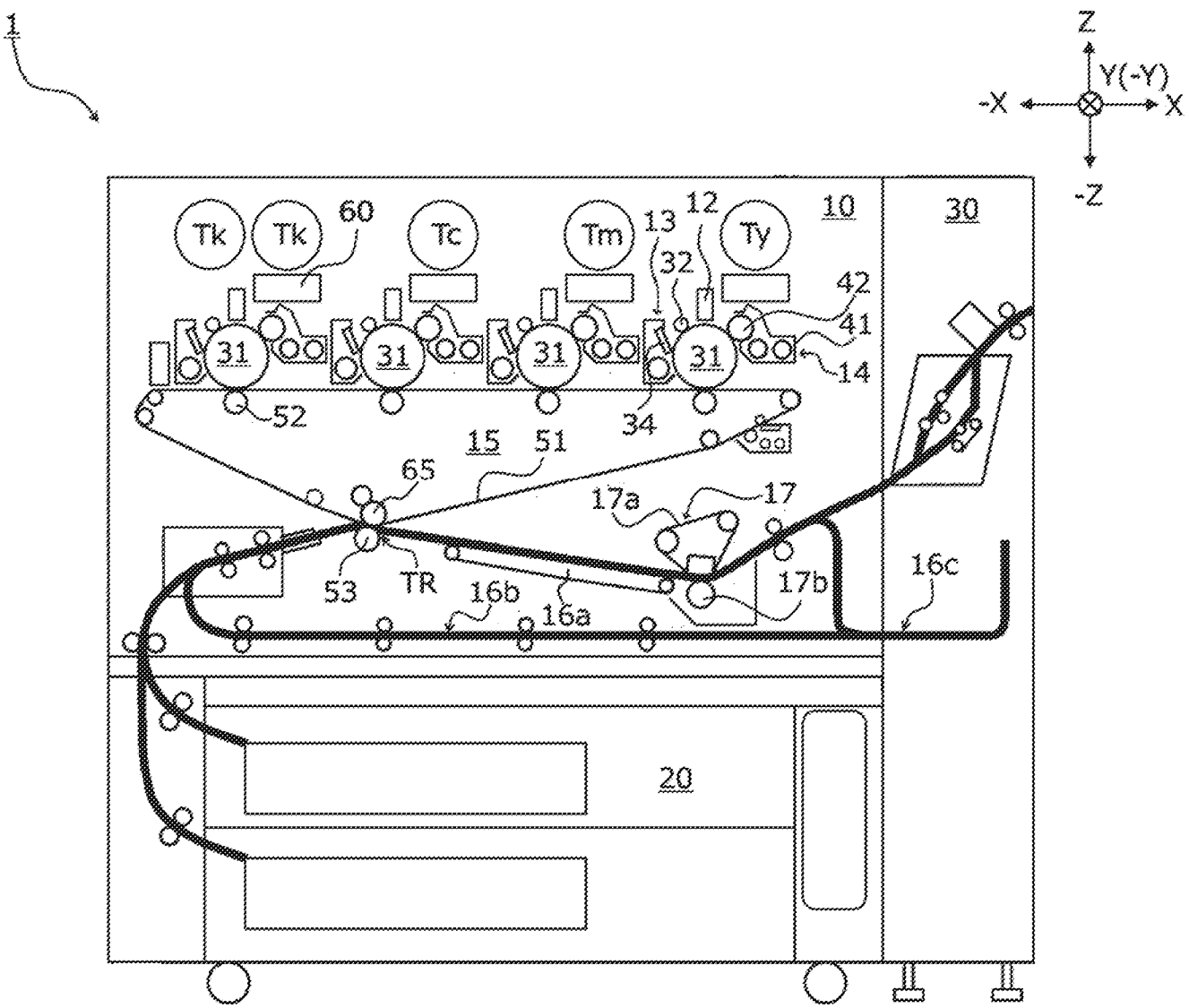
FIG. 1 is a schematic cross-sectional view showing an example of a schematic configuration of an image forming apparatus.

Next, the present disclosure will be described in more detail with reference to the drawings below with reference to exemplary embodiments and specific examples, but the present disclosure is not limited to these exemplary embodiments and specific examples.

In the following description using the drawings, the drawings are schematic, and it should be noted that ratios of dimensions and the like are different from actual ones, and illustration other than members necessary for description is omitted as appropriate for easy understanding.

In order to facilitate understanding of the following description, in the drawings, a front-rear direction is referred to as an X-axis direction, a left-right direction is referred to as a Y-axis direction, and an up-down direction is referred to as a Z-axis direction.

(1) Overall Configuration and Operation of Image Forming Apparatus (1.1) Overall Configuration of Image Forming Apparatus FIG. 1 is a schematic cross-sectional view showing an example of a schematic configuration of an image forming apparatus 1 according to a present exemplary embodiment.

The image forming apparatus 1 includes an image forming unit 10, a sheet feeding device 20 attached to one end of the image forming unit 10, a sheet output unit 30 provided at another end of the image forming unit 10 and configured to eject a printed sheet, and an image processing unit (not shown) configured to generate image information from printing information transmitted from an upper device.

The image forming unit 10 includes a system control device (not shown), exposure devices 12, photoconductor units 13, developing devices 14, a transfer device 15, sheet transport devices 16*a*, 16*b*, and 16*c*, a fixing device 17, and a drive device (not shown), and forms image information received from the image processing unit as a toner image on a sheet fed from the sheet feeding device 20.

The sheet feeding device 20 supplies sheets to the image forming unit 10. That is, plural sheet loading units that accommodate sheets of different types (for example, material, thickness, sheet size, and grain) are included, and the sheet fed from any one of the plural sheet loading units is supplied to the image forming unit 10.

The sheet output unit 30 outputs the sheet on which image output is performed in the image forming unit 10. Therefore, the sheet output unit 30 includes an output sheet accommodating unit to which the sheet after the image output is output. The sheet output unit 30 may have a function of performing a post-processing such as cutting and stapling (staple binding) on a sheet bundle output from the image forming unit 10.

(1.2) Configuration and Operation of Image Forming Unit

In the image forming apparatus 1 having such a configuration, in the sheet feeding device 20 in accordance with a timing of image formation, the sheet fed from the sheet loading unit designated for each sheet of printing in a print job is fed to the image forming unit 10.

The photoconductor units 13, as examples of a first unit, include photoconductor drums 31 as image holders that are provided below the exposure devices 12 in parallel and are rotationally driven. A charging roller 32, the exposure device 12, the developing device 14, a primary transfer roller 52, and a cleaning blade 34 are disposed along a rotation direction of the photoconductor drum 31.

The developing device 14, as an example of a second unit, includes a developing housing 41 in which a developer is accommodated. A developing roller 42 that faces the photoconductor drum 31 is disposed in the developing housing 41.

Developing devices 14 have substantially the same configuration except for the developer collected in the developing housing 41, and each forms a toner image of yellow (Y), magenta (M), cyan (C), and black (K).

Above the developing device 14, a replaceable toner cartridge T that accommodates the developer (a toner including a carrier) and a developer supply device 60 that supplies the developer from each toner cartridge T to the developing device 14 are disposed. In the present exemplary embodiment, toner cartridges Ty, Tm, and Tc of yellow (Y), magenta (M), and cyan (C) and two toner cartridges Tk of black (K) are attachable and detachable.

A surface of the rotating photoconductor drum 31 is charged by the charging roller 32, and an electrostatic latent image is formed by latent image forming light emitted from the exposure device 12. The electrostatic latent image formed on the photoconductor drum 31 is developed as a toner image by the developing roller 42.

The transfer device 15 includes an intermediate transfer belt 51 onto which toner images of respective colors formed on the photoconductor drums 31 of respective photoconductor units 13 are multiply transferred, the primary transfer rollers 52 that sequentially transfer (primarily transfer) the toner images of the respective colors formed on the photoconductor units 13 to the intermediate transfer belt 51, and a secondary transfer roller 53 that collectively transfers (secondarily transfers) the toner images of the respective colors superimposed and transferred onto the intermediate transfer belt 51 onto the sheet as a recording medium.

The toner images of the respective colors formed on the photoconductor drums 31 of the respective photoconductor units 13 are sequentially electrostatically transferred (primarily transferred) onto the intermediate transfer belt 51 by the primary transfer rollers 52 to which a predetermined transfer voltage is applied from a power supply device (not shown) controlled by the system control device, and a superimposed toner image in which toners of the respective colors are superimposed is formed.

With a movement of the intermediate transfer belt 51, the superimposed toner image on the intermediate transfer belt 51 is transported to a secondary transfer unit TR in which the secondary transfer roller 53 is disposed in press-contact with a backup roller 65 via the intermediate transfer belt 51.

When the superimposed toner image is transported to the secondary transfer unit TR, the sheet is supplied to the secondary transfer unit TR from the sheet feeding device 20 in accordance with the timing. Then, a predetermined secondary transfer voltage is applied from the power supply device controlled by the system control device to the backup roller 65 facing the secondary transfer roller 53 via the intermediate transfer belt 51, and the multiple toner images on the intermediate transfer belt 51 are collectively transferred to the sheet.

Residual toner on the surface of the photoconductor drum 31 is removed by the cleaning blade 34 and collected in a waste toner collecting unit (not shown). The surface of the photoconductor drum 31 is re-charged by the charging roller 32.

The fixing device 17 includes an endless fixing belt 17*a* that rotates in one direction, and a pressure roller 17*b* that is in contact with a peripheral surface of the fixing belt 17*a* and rotates in one direction, and a nip (a fixing region) is formed by a press-contact region between the fixing belt 17*a* and the pressure roller 17*b*.

The sheet on which the toner image is transferred in the transfer device 15 is transported to the fixing device 17 via the sheet transport device 16*a* in a state where the toner image is not fixed. On the sheet transported to the fixing device 17, the toner image is fixed by pressure bonding and heating by the pair of fixing belt 17*a* and pressure roller 17*b*.

The sheet on which the fixing is completed is fed to the sheet output unit 30 via the sheet transport device 16*b*.

When the image output is performed on both sides of the sheet, a front and a back of the sheet are reversed by the sheet transport device 16*c*, and the sheet is fed again to the secondary transfer unit TR in the image forming unit 10. After transfer of the toner image and fixing of a transfer image are performed, the sheet is fed to the sheet output unit 30. The sheet fed to the sheet output unit 30 is subjected to the post-processing such as cutting and stapling (staple binding) as necessary, and then output to the output sheet accommodating unit.

(2) Unit Configuration and Mounting Operation of Image Forming Apparatus

Figure 2:
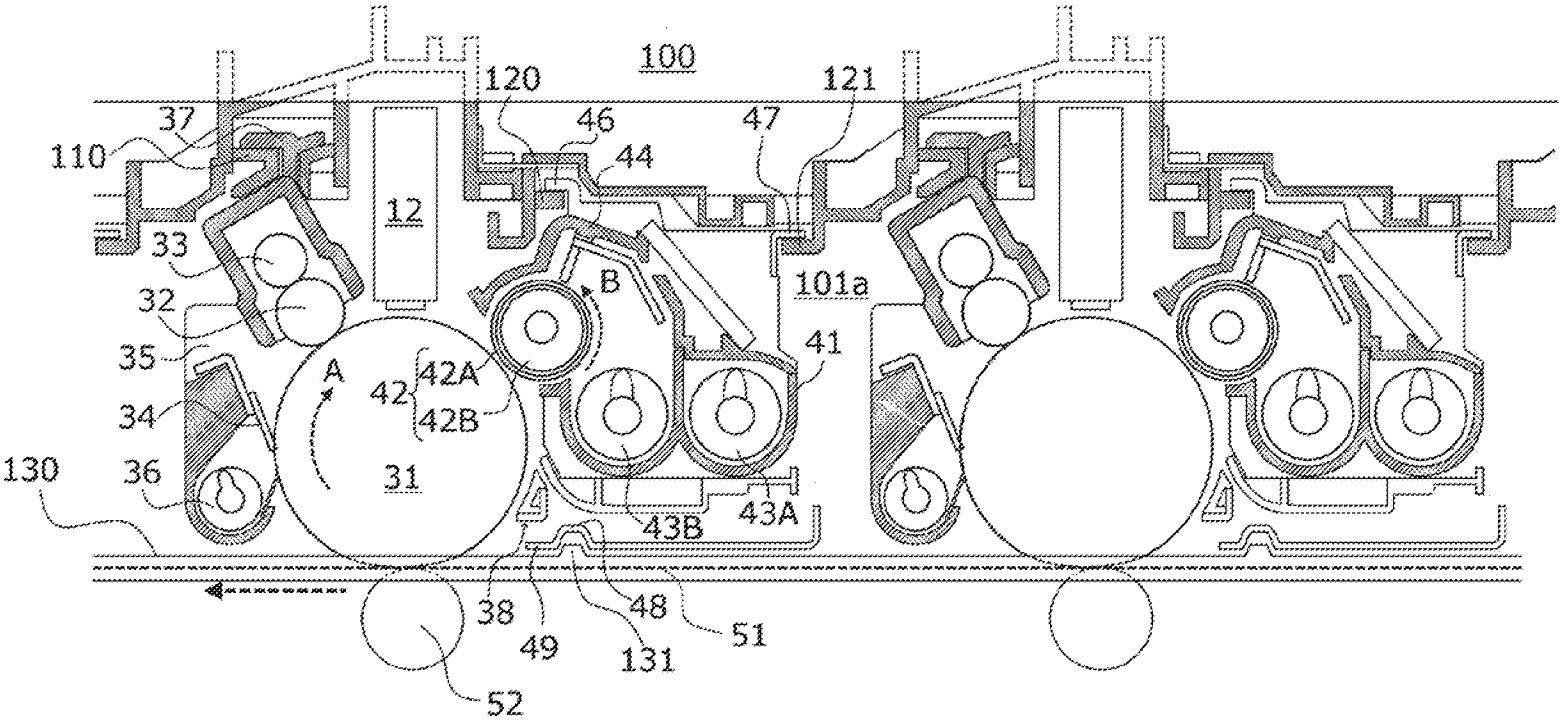
FIG. 2 is a schematic cross-sectional view showing a unit configuration in the image forming apparatus.
Figure 3A:
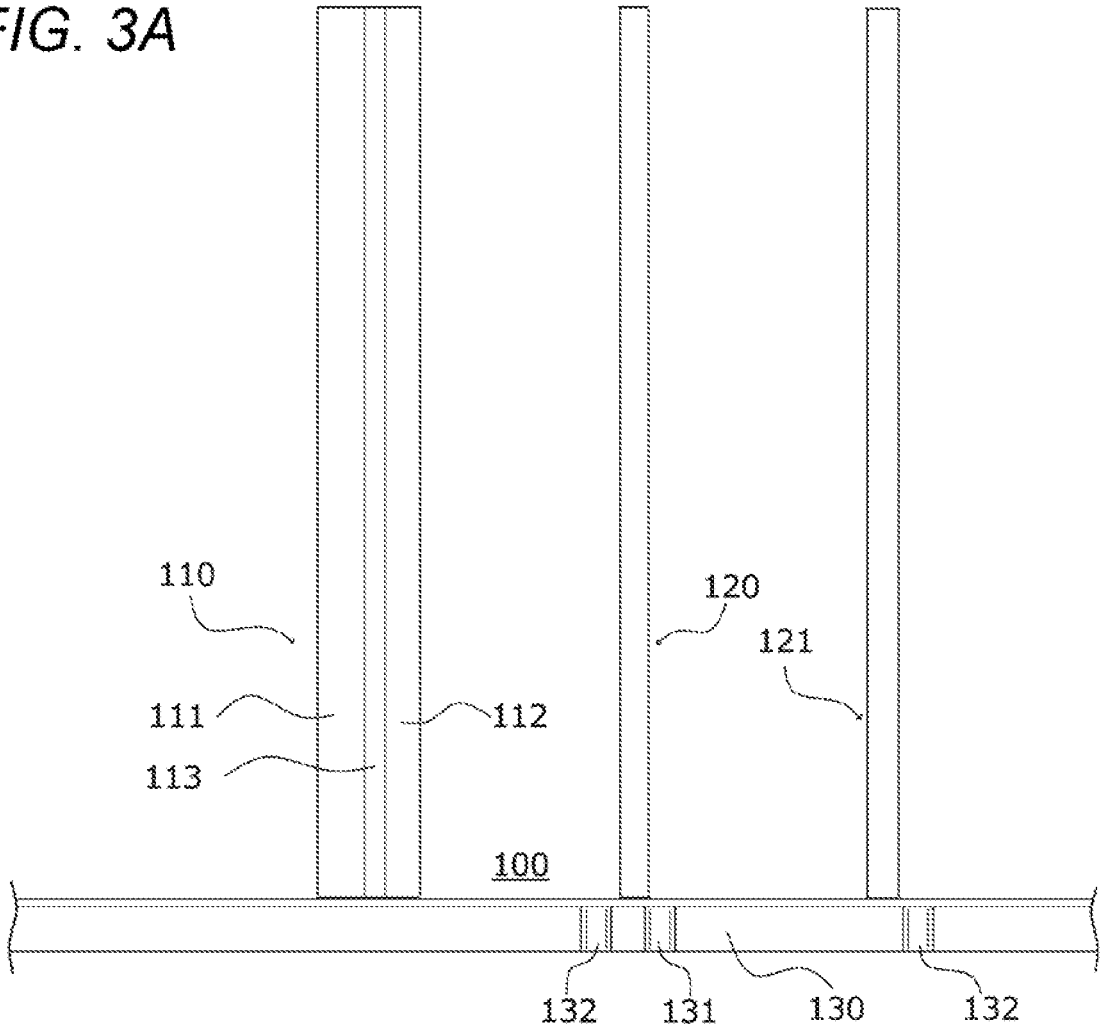
FIG. 3A is a schematic plan view showing an arrangement of a first guide, second guides and a pedestal of an apparatus housing.
Figure 3B:
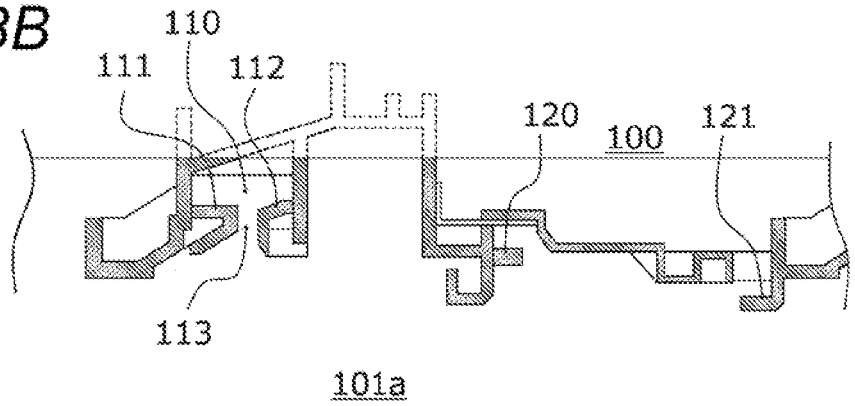
FIG. 3B is a schematic vertical cross-sectional view showing the arrangement.
Figure 3B:
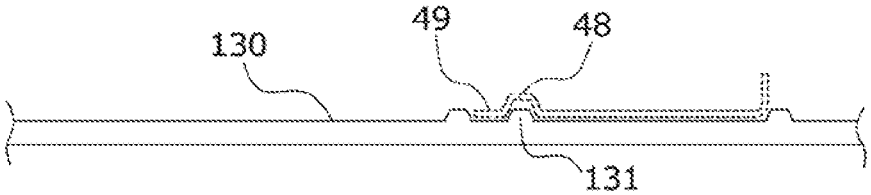

FIG. 2 is a schematic cross-sectional view showing a unit configuration in the image forming apparatus 1; FIG. 3A is a schematic plan view showing an arrangement of a first guide 110, second guides 120, 121, and a pedestal 130 of an apparatus housing, and FIG. 3B is a schematic vertical cross-sectional view showing the arrangement. Hereinafter, the configuration and the mounting operation of the photoconductor unit 13, the developing device 14, and the apparatus housing 100 will be described with reference to the drawings.

As shown in FIG. 2, in the image forming apparatus 1, the plural photoconductor units 13 and developing device 14 are attachably and detachably accommodated and arranged in the apparatus housing 100.

(2.1) Photoconductor Unit

As shown in FIG. 2, in the photoconductor unit 13, the photoconductor drum 31 is rotatably supported by a unit housing 35 (indicated by an arrow A in FIG. 2), and the charging roller 32, a cleaning roller 33, the cleaning blade 34, and a transporting auger 36 that transports the toner removed by the cleaning blade 34 to a waste toner collection container (not shown) are disposed in the unit housing 35.

The unit housing 35 is integrally provided with a first hook 37 as an example of a hook shape that is engaged with the first guide 110 provided in the apparatus housing 100 to be described later. The first hook 37 is formed to protrude upward (in a Z direction) at the uppermost position of the photoconductor unit 13 and extend from a front side toward a rear side of the photoconductor unit 13, and guides the insertion and removal of the photoconductor unit 13 into and from the apparatus housing 100 in a state of being suspended by the first guide 110 provided in the apparatus housing 100.

Further, the unit housing 35 is provided with a fifth guide 38 extending from the front side toward the rear side of the photoconductor unit 13 with a gap between the unit housing 35 and the photoconductor drum 31 below the photoreceptor unit 13. The fifth guide 38 is guided by the developing device 14 previously inserted into the apparatus housing 100, and stabilizes the posture of the photoconductor unit 13 that is suspended by the first guide 110 and to be inserted and removed.

(2.2) Developing Device

As shown in FIG. 2, in the developing device 14, the developing roller 42 is rotatably supported by the developing housing 41, and a stirring auger 43A and a supply auger 43B are disposed in the developing housing 41. The developer is filled around the stirring auger 43A and the supply auger 43B in the developing housing 41, and the stirring auger 43A and the supply auger 43B are closed by the cover member 44.

The developing roller 42 includes a cylindrical developing sleeve 42A rotatably supported with respect to the developing housing 41, and a magnet 42B as a columnar magnet member provided in an internal space of the developing sleeve 42A and fixed to the developing housing 41.

The developing sleeve 42A is configured such that the developer is held on an outer circumferential surface by a magnetic force of the magnet 42B, and the developer is transported and supplied to the electrostatic latent image on the photoconductor drum 31 by rotation of the developing sleeve 42A (indicated by an arrow B in FIG. 2).

The developing housing 41 is provided with second hooks 46, 47 as an example of a hook shape that engage with the second guides 120, 121 provided in the apparatus housing 100. The second hook 46 is formed on the rear side in an insertion and removal direction of the developing housing 41, and guides the insertion and removal of the developing device 14 into and from the apparatus housing 100 in a state where the second hook 46 is suspended by the second guide 120 provided in the apparatus housing 100. The second hook 47 is formed to extend from the front side toward the rear side in the insertion and removal direction of the developing housing 41, and guides the insertion and removal of the developing device 14 into and from the apparatus housing 100 in a state where the second hook 47 is suspended by the second guide 121 provided in the apparatus housing 100.

A guide groove 48 is formed on a lower surface of the developing device 14 so as to be fitted to a third guide 131 provided on the pedestal 130 of the apparatus housing 100 described later and to restrict left and right movements of the developing device 14 when the developing device 14 starts to be inserted into the apparatus housing 100. A fourth guide 49 that receives the fifth guide 38 provided in the photoconductor unit 13 to be inserted later and guides insertion and removal of the photoconductor unit 13 is provided on a tip end side of the guide groove 48 facing the photoconductor unit 13.

(2.3) Apparatus Housing

The apparatus housing 100 has an opening 101*a* on a front side, which is the front surface of the image forming apparatus 1, and the photoconductor unit 13 and the developing device 14 can be inserted and removed from the apparatus housing 100.

As shown in FIGS. 3A and 3B, the apparatus housing 100 is provided with the first guide 110, the second guides 120, 121 corresponding to the photoconductor unit 13 and the developing device 14 to be inserted and removed, respectively.

As shown in FIG. 3A, the first guide 110 is provided to extend from a front side toward a rear side of the apparatus housing 100 (in a Y direction). As shown in FIG. 3B, in the first guide 110, receiving portions 111 and 112 face each other, and a groove portion 113 is formed in a central portion. The first guide 110 receives the first hook 37 provided in the photoconductor unit 13 inserted from the front side by the groove portion 113, and is suspended and held by the receiving portions 111, 112.

As shown in FIG. 3A, the second guides 120, 121 are provided to extend from the front side toward the rear side of the apparatus housing 100 (in the Y direction). The second guide 120 is engaged with the second hook 46 provided in the developing device 14 to suspend and hold a developing roller 42 side of the developing device 14 inserted from the front side of the apparatus housing 100. The second guide 121 is engaged with the second hook 47 provided in the developing device 14 to suspend and hold a stirring auger 43A side of the developing device 14 inserted from the front side of the apparatus housing 100.

In the present exemplary embodiment, among the photoconductor unit 13 and the developing device 14 that are attachable to and detachable from the apparatus housing 100, the developing device 14 is mounted first, and the developing device 14 is suspended from the second guides 120, 121 that are provided separately from each other in a direction intersecting with the insertion and removal direction in the apparatus housing 100, and is inserted and removed in a state in which the developing device 14 is kept horizontal.

As shown in FIGS. 3A and 3B, a pedestal 130 is provided on the front side of the first guide 110 and the second guides 120 and 121 of the apparatus housing 100 in the insertion and removal direction of the photoconductor unit and the developing device 14. The pedestal 130 is provided at a position that does not overlap the first guide 110 and the second guide 120 in a plan view in front of the apparatus housing 100, and supports the photoconductor unit 13 and the developing device 14 to be inserted from below in a gravity direction. The pedestal 130 has a height that does not come into contact with the photoconductor unit 13 and the developing device 14 inserted into the apparatus housing 100 (see FIG. 2).

The third guide 131 is provided on an upper surface of the pedestal 130. The third guide 131 protrudes upward and extends in the insertion and removal direction on the pedestal 130. Prior to the engagement of the second hooks 46, 47 of the developing device 14 with the second guides 120, 121, the third guide 131 fits into the guide groove 48 of the developing device 14 placed on the pedestal 130 to restrict the left and right movements of the developing device 14. Accordingly, it is possible to stabilize the posture when the developing device 14 is inserted into the apparatus housing 100.

As shown in FIGS. 3A and 3B, guides 132 may be provided on the upper surface of the pedestal 130 so as to correspond to both end portions in a direction intersecting the insertion and removal direction of the developing device 14, and the left and right movements of the developing device 14 may be restricted.

(2.4) Mounting of Photoconductor Unit 13 and Developing Device 14

Figure 4:
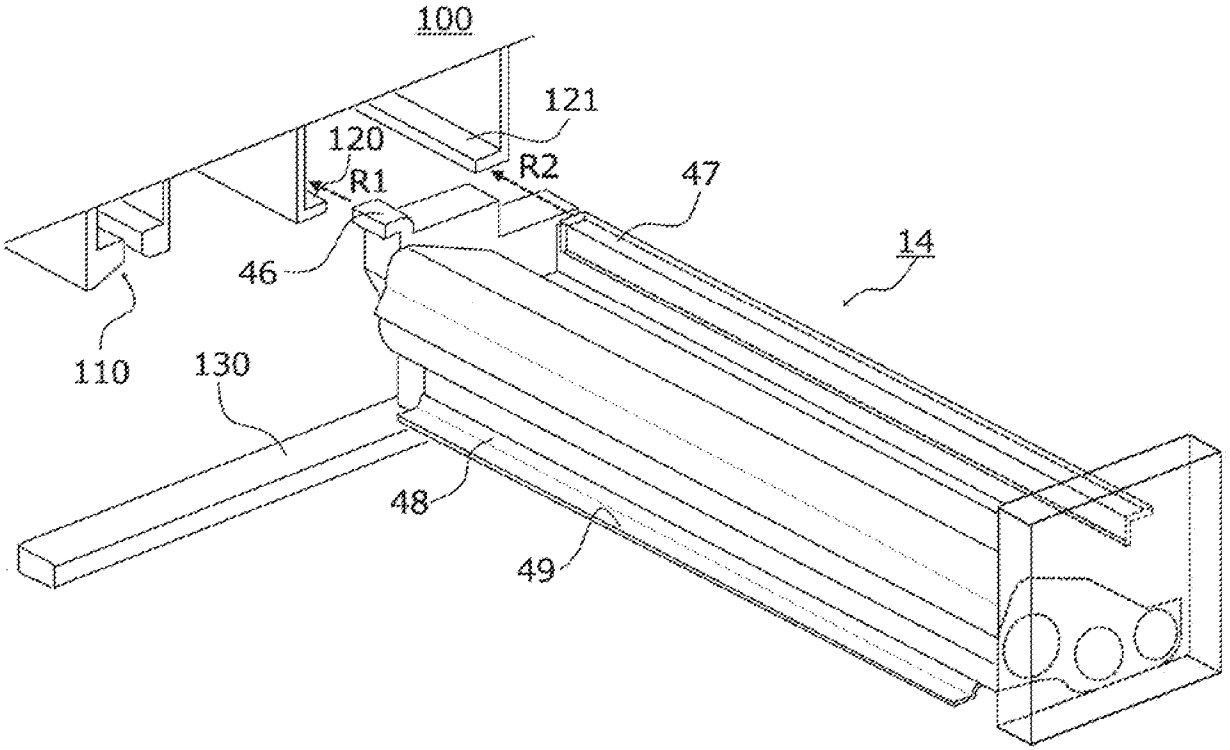
FIG. 4 is a perspective view showing mounting of a developing device on the apparatus housing.
Figure 5:
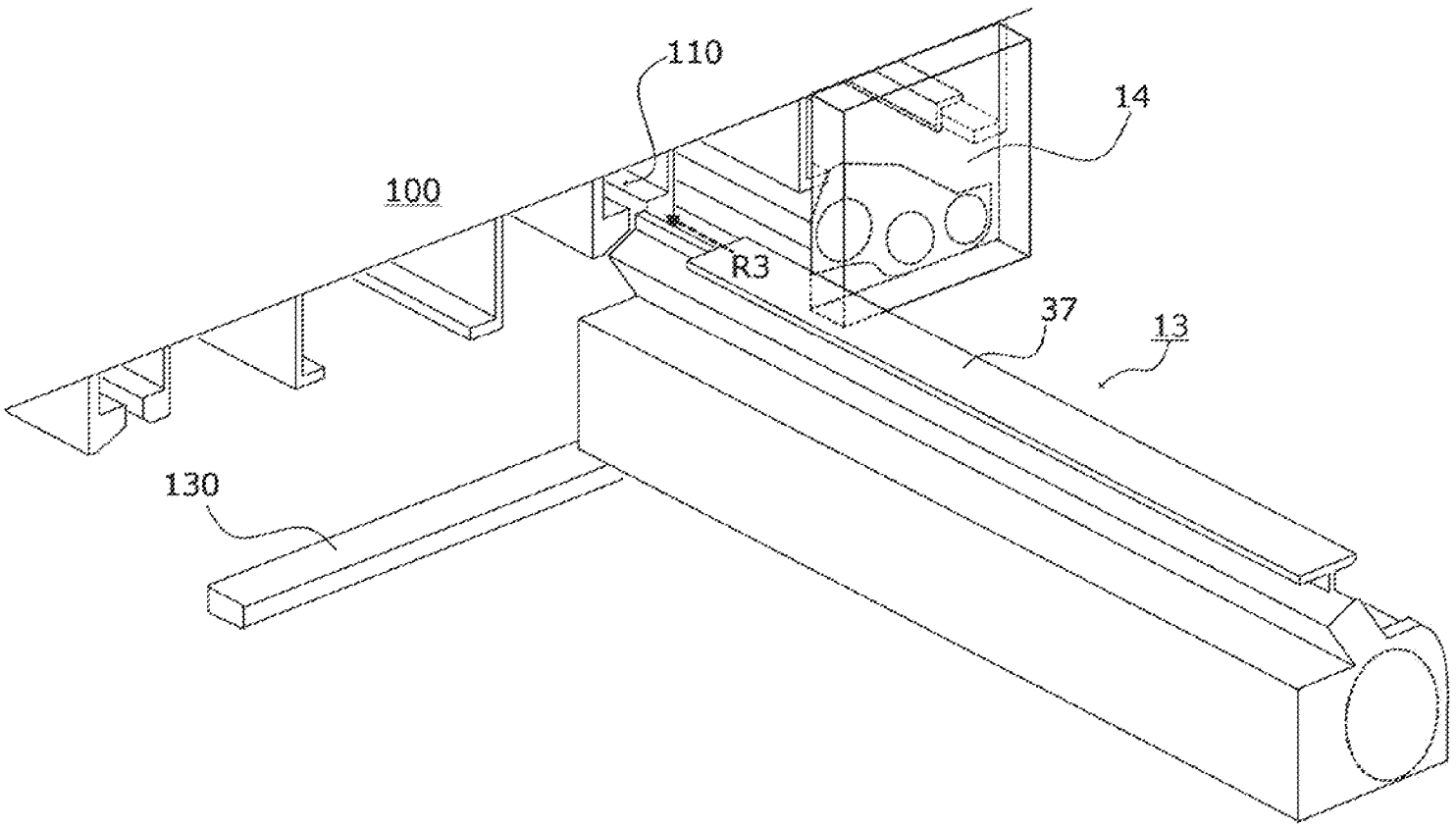
FIG. 5 is a perspective view showing mounting of a photoconductor unit on the apparatus housing.
Figure 6:
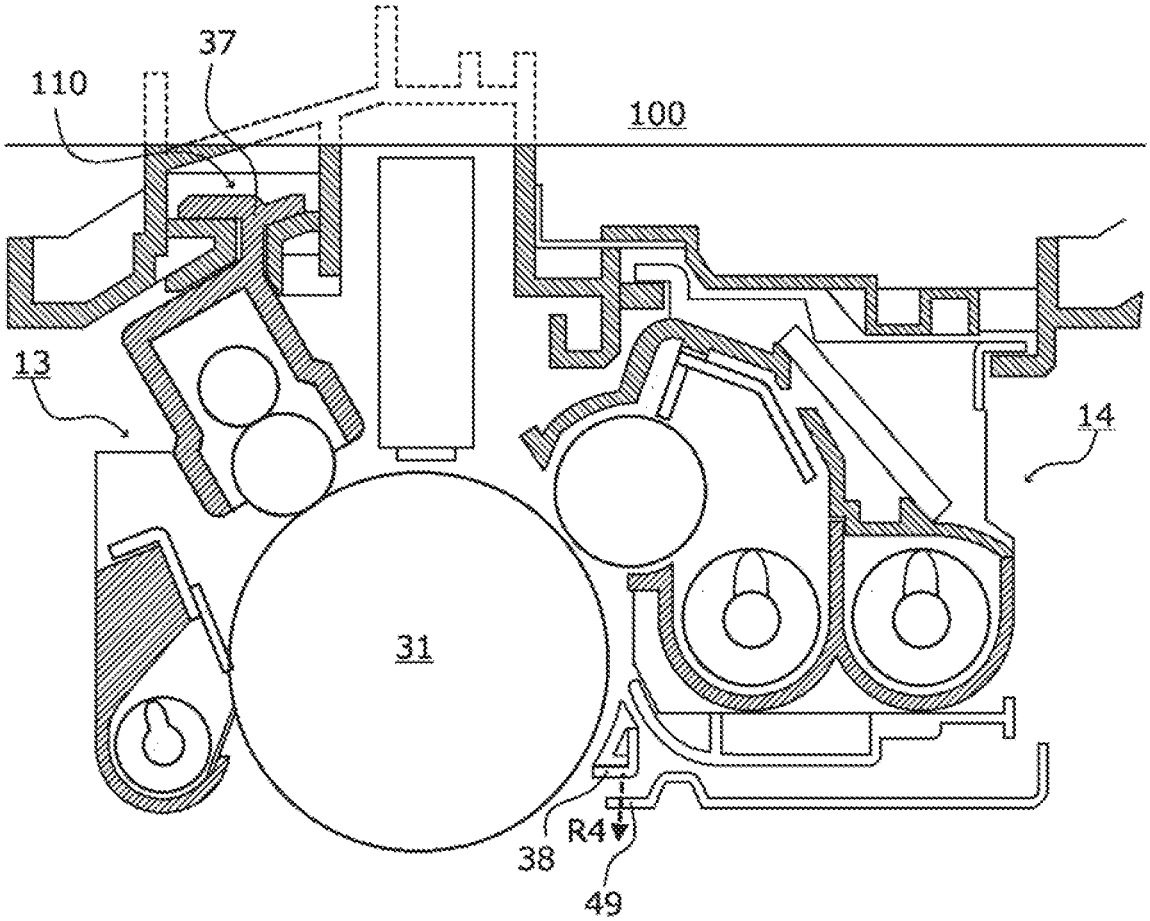
FIG. 6 is a front cross-sectional view showing mounting of the photoconductor unit in a state where the developing device is previously mounted.

FIG. 4 is a perspective view showing mounting of the developing device 14 on the apparatus housing 100, FIG. 5 is a perspective view showing mounting of the photoconductor unit 13 on the apparatus housing 100, and FIG. 6 is a front cross-sectional view showing mounting of the photoconductor unit 13 in a state where the developing device 14 is previously mounted. Hereinafter, the mounting of the photoconductor unit 13 and the developing device 14 will be described with reference to the drawings.

As shown in FIG. 4, when the developing device 14 is mounted on the apparatus housing 100, first, the rear side of the developing device 14 in the insertion and removal direction is placed on the pedestal 130, and the developing device 14 is supported from below in the gravity direction. At this time, the guide groove 48 of the developing device 14 shown in FIG. 3B is placed on the third guide 131 on the pedestal 130 so as to be fitted into the third guide 131 in the insertion and removal direction. Accordingly, the developing device 14 having a heavy weight is temporarily supported from below in the weight direction, and the developing device 14 can be mounted in a longitudinal direction from the front of the apparatus housing 100.

Then, while being supported by the pedestal 130, the developing device 14 is slid toward the second guides 120, 121, the second hook 46 of the developing device 14 is placed on the second guide 120 (see an arrow R1 in FIG. 4), and the second hook 47 is placed on the second guide 121 (see an arrow R2 in FIG. 4) and moved toward the rear side. Accordingly, the developing device 14 is held in a suspended state by the second hooks 46, 47 on the second guides 120, 121 of the apparatus housing 100, and the unit replacement is facilitated.

When the photoconductor unit 13 is mounted on the apparatus housing 100, as shown in FIG. 5, first, in a state where the developing device 14 is mounted on the apparatus housing 100, first, the rear side in the insertion and removal direction of the photoconductor unit 13 is placed on the pedestal 130, and the photoconductor unit 13 is supported from below in the gravity direction.

Then, while being supported by the pedestal 130, the photoconductor unit 13 is slid toward the first guide 110 (see an arrow R3 in FIG. 5), and the first hook 37 of the photoconductor unit 13 is placed on the first guide 110 and moved toward the rear side. At this time, as shown in FIG. 6, below the photoconductor unit 13, the fifth guide 38 provided on a side opposite to the developing device 14 that is mounted first is guided by the fourth guide 49 provided on the lower surface of the developing device 14, so that the insertion posture of the photoconductor unit 13 is stabilized. That is, the rotation (see an arrow R4 in FIG. 6) of the photoconductor unit 13 suspended by the first hook 37 that is engaged with the first guide 110 about the first hook 37 is restricted by the fourth guide 49 provided in the developing device 14. Accordingly, damage to the photoconductor drum 31 is prevented and unit replacement is facilitated.

(2.5) Operation of Fifth Guide

Figure 7A:
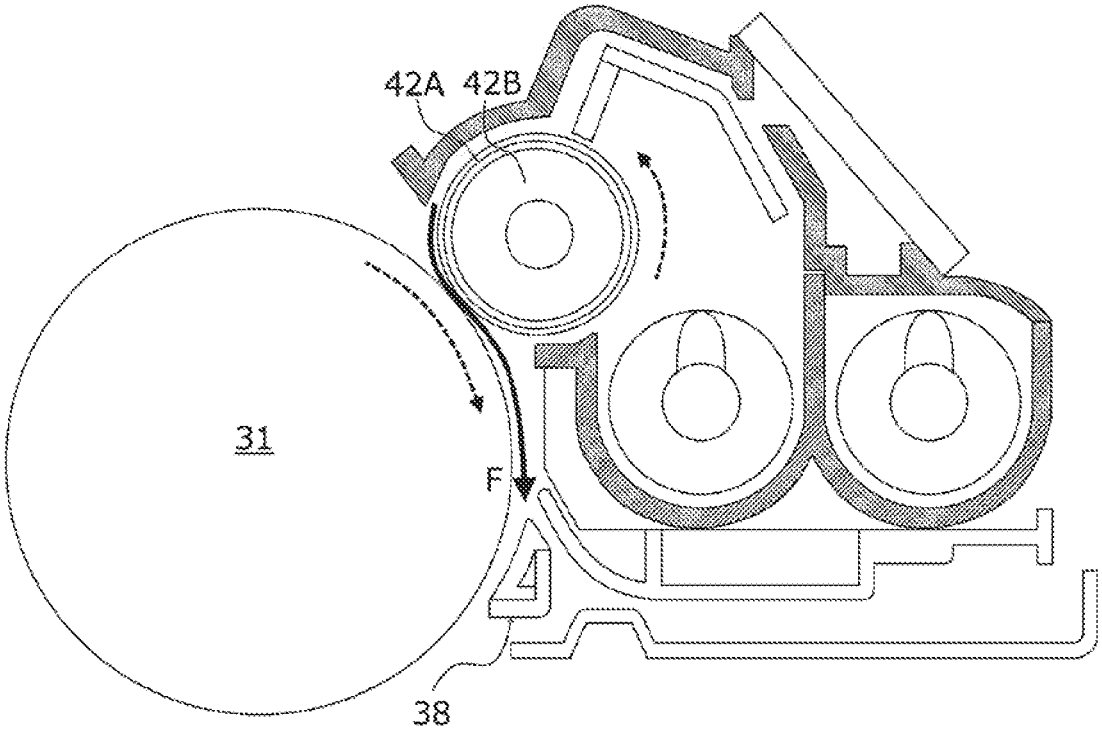
FIG. 7A is a diagram showing an air flow due to rotation of the developing roller and the photoconductor drum.
Figure 7B:
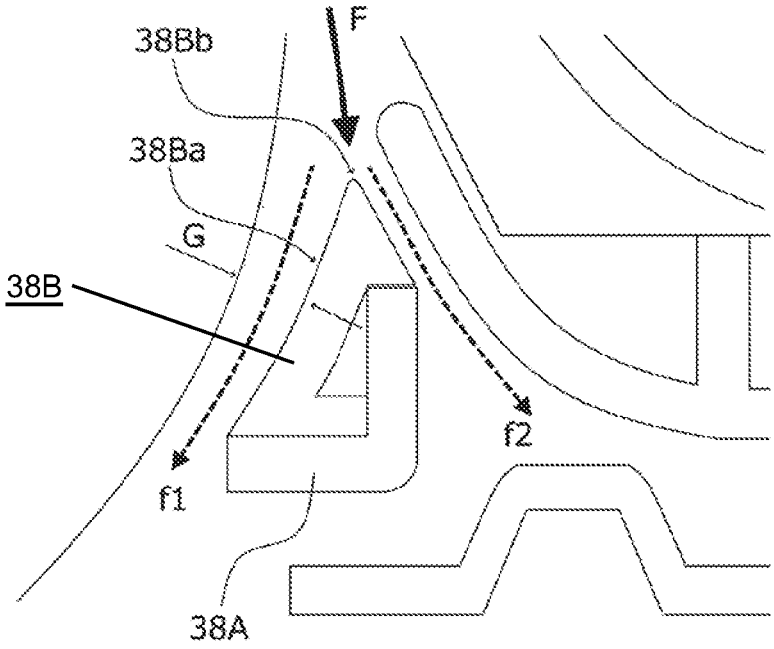
FIG. 7B is a diagram showing the air flow separated by a fifth guide.

FIG. 7A is a diagram showing an air flow due to rotation of the developing roller 42 and the photoconductor drum 31, and FIG. 7B is a diagram showing the air flow separated by the fifth guide 38.

As shown in FIG. 7A, the developing roller 42 rotates while holding the developer on an outer circumferential surface of the developing sleeve 42A by the magnetic force of the magnet 42B, thereby transporting and supplying the developer to an electrostatic latent image of the rotating photoconductor drum 31. Therefore, the air flow as a rotation flow (see an arrow F in the drawing) is formed on a downstream side in the rotation direction of the developing roller 42. The air contains cloud toner generated during development, the cloud toner is collected around the fifth guide 38, and a part of the cloud toner may fall onto the intermediate transfer belt 51 that circulates below the photoconductor unit 13 and the developing device 14.

The fifth guide 38 according to the present exemplary embodiment is formed below the photoconductor unit 13 so as to extend from the front side to the rear side of the photoconductor unit 13 with the gap between the photoconductor drum 31 and the fifth guide 38. As shown in FIG. 7B, the substantially triangular guide member 38B of the fifth guide 38 having the apex in the upper direction (the Z direction) is attached to a metal plate 38A having an L-shaped cross section. The plate 38A extends from a front side to a rear side of the unit housing 35, and serves as a tie bar for reinforcing the unit housing 35.

The guide member 38B is formed of a synthetic resin, and the triangular shape is formed of an inclined surface having an inclination angle exceeding an angle of repose of the toner. The angle of repose of the toner varies depending on a type of the developer, a usage environment such as the temperature and humidity. Accordingly, even if the cloud toner adheres to the surface of the guide member 38B, the toner carried on the attached toner slides down, and the accumulation and fall of the toner on the surface of the guide member 38B may be suppressed.

As shown in FIG. 7B, the triangular shape of the guide member 38B is formed such that a surface 38Ba facing the photoconductor drum 31 has a predetermined gap G with respect to the curvature of the photoconductor drum 31. Accordingly, the air flow formed on the downstream side in the rotation direction of the developing roller 42 is divided into a photoconductor drum 31 side (an arrow f1 in the drawing) and a developing device 14 side (an arrow f2 in the drawing) with the vertex 38Bb of the guide member 38B as a base point, and stagnation of the toner cloud is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

For example, in the present exemplary embodiment, the intermediate transfer type image forming apparatus 1 including the intermediate transfer belt has been described as the belt unit, but the present exemplary embodiment can be applied to a direct transfer type image forming apparatus that contacts a photoconductor drum via a recording medium held on a transport belt and transfers and transports a toner image on the photoconductor drum.

Further, the present invention can be applied not only to a tandem image forming apparatus but also to an image forming apparatus including a photoconductor unit and a developing device.

REFERENCES SIGNS LIST

1 image forming apparatus
10 image forming unit
13 photoconductor unit
31 photoconductor drum
35 unit housing
37 first hook
38 fifth guide
14 developing device
41 developing housing
42 developing roller
46, 47 second hook
48 guide groove
49 fourth guide
20 sheet feeding device
30 sheet output unit
100 apparatus housing
110 first guide
120, 121 second guide
130 pedestal
131 third guide

What is claimed is:

1. An image forming apparatus comprising:

a first guide that is provided in an apparatus housing and configured to suspend and hold a first unit including an image holder so that the first unit is movable in an insertion and removal direction;

a second guide that is provided in the apparatus housing and configured to suspend and hold a second unit including a developer holder so that the second unit is movable in an insertion and removal direction;

a pedestal that is disposed on a front side in the insertion and removal direction with respect to the first guide and the second guide, supports, from below in a gravity direction, the first unit and the second unit while the first unit and the second unit are inserted into the apparatus housing, and does not contact with the first unit and the second unit located in the apparatus housing; and a third guide, on the pedestal, that is fitted to the second unit and restricts movement of the first unit in a direction intersecting the insertion and removal direction.

2. The image forming apparatus according to claim 1, wherein the first unit has a hook shape that is engaged with the first guide.

3. The image forming apparatus according to claim 2, wherein the second unit has a fourth guide that guides insertion and removal of the first unit.

4. The image forming apparatus according to claim 3, wherein the first unit has a fifth guide by which insertion and removal of the first unit is guided by the fourth guide.

5. The image forming apparatus according to claim 1, wherein the second unit has a hook shape that is engaged with the second guide.

6. The image forming apparatus according to claim 5, wherein the second unit has a fourth guide that guides insertion and removal of the first unit.

7. The image forming apparatus according to claim 1, wherein the second unit has a fourth guide that guides insertion and removal of the first unit.

8. The image forming apparatus according to claim 7, wherein the first unit has a fifth guide by which insertion and removal of the first unit is guided by the fourth guide.

9. The image forming apparatus according to claim 1, wherein the image holder is a photoconductor drum, and wherein the first unit is a drum unit.

10. An image forming apparatus comprising:

a first guide that is provided in an apparatus housing and configured to suspend and hold a first unit including an image holder so that the first unit is movable in an insertion and removal direction;

a second guide that is provided in the apparatus housing and configured to suspend and hold a second unit including a developer holder so that the second unit is movable in an insertion and removal direction; and a pedestal that is disposed on a front side in the insertion and removal direction with respect to the first guide and the second guide, supports, from below in a gravity direction, the first unit and the second unit while the first unit and the second unit are inserted into the apparatus housing, and does not contact with the first unit and the second unit located in the apparatus housing, wherein the second unit has a third guide that guides insertion and removal of the first unit.

11. The image forming apparatus according to claim 10, wherein the first unit has a fourth guide by which insertion and removal of the first unit is guided by the third guide.

12. The image forming apparatus according to claim 11, wherein the fourth guide has a substantially triangular cross-sectional shape having an apex at an upper side so that the substantially triangular cross-sectional shape separates an air flow accompanying rotation of the image holder and the developer holder.

13. The image forming apparatus according to claim 12, wherein the substantially triangular cross-sectional shape is formed by an inclined surface having an inclination angle exceeding an angle of repose of a toner.

14. The image forming apparatus according to claim 12, wherein the substantially triangular cross-sectional shape has an inclined surface having a predetermined gap with respect to a curvature of the image holder as one side.

15. The image forming apparatus according to claim 11, wherein the fourth guide is a tie bar that connects both end portions of the first unit in the insertion and removal direction.

* * * * *